US005703557A

United States Patent [19]

Osada et al.

[11] Patent Number: 5,703,557

[45] Date of Patent: Dec. 30, 1997

[54] NOISE ABSORBING DEVICE

[75] Inventors: Takayuki Osada; Fumishiro Tsuda; Norio Saito; Takeji Ihara; Yoshio Wagatsuma; Hitoshi Moriya, all of Miyagi, Japan

[73] Assignee: Tokin Corporation, Miyagi, Japan

[21] Appl. No.: 797,855

[22] Filed: Feb. 10, 1997

Related U.S. Application Data

[63] Continuation of Ser. No. 392,810, filed as PCT/JP94/01121, Jul. 8, 1994, published as WO95/0225 Jan. 19, 1995, abandoned.

[30] Foreign Application Priority Data

| | | | |
|---|---|---|---|
| Jul. 8, 1993 | [JP] | Japan | 5-169276 |
| Sep. 1, 1993 | [JP] | Japan | 5-217463 |
| Sep. 21, 1993 | [JP] | Japan | 5-235235 |

[51] Int. Cl.[6] ..... H01F 17/06; H01F 27/02; H01F 27/26

[52] U.S. Cl. ..... 336/92; 333/12; 336/176; 336/212

[58] Field of Search ..... 324/127; 174/92, 174/135; 333/81 R, 12, 182, 243, 183; 336/92, 174, 175, 176, 212

[56] References Cited

U.S. PATENT DOCUMENTS

| | | | |
|---|---|---|---|
| 3,148,241 | 9/1964 | Moore | 176/135 |
| 4,885,559 | 12/1989 | Nakano | 336/176 |
| 4,972,167 | 11/1990 | Fujioko | 174/92 |

FOREIGN PATENT DOCUMENTS

| | | | |
|---|---|---|---|
| 4-36007 | 12/1992 | Japan | 336/176 |
| 5-50705 | 7/1993 | Japan | 336/176 |

*Primary Examiner*—Thomas J. Kozma
*Attorney, Agent, or Firm*—Hopgood, Calimafde, Kalil & Judlowe LLP

[57] ABSTRACT

A noise absorbing device is adapted to prevent radiation noise or induction noise from a cable connected to an electronic apparatus. A pair of holder segments (11 and 12) receive core pieces (20) in receiving recesses and are coupled by hinge portions (19) so as to be brought into butt contact with each other so that the pair of core pieces (20) form a cylindrical body with a cable extending therethrough. Elastic pieces (31) are interposed between the pair of core pieces (20) and the pair of holder segments (11 and 12) in order to provide an elastic force to the core pieces (20) so that the core pieces are slightly protruded from opening edges of the holder segments (11 and 12). When the pair of holder segments (11 and 12) are brought into butt contact with each other, the pair of core pieces (20) are put into press contact with each other by the elastic force of the elastic pieces (60). An assembly of the core piece (20) and the elastic piece (31) engaged therewith is press fitted into the receiving recess to avoid drop-off from each of the holder segments (11 and 12).

4 Claims, 6 Drawing Sheets

NOISE ABSORBING DEVICE

This application is a continuation of application Ser. No. 392,810, filed as PCT/JP94/01121, Jul. 8, 1994, published as WO95/0225, Jan 19, 1995, now abandoned.

TECHNICAL FIELD

This invention relates to a noise absorbing device having a cylindrical magnetic core, for preventing radiation noise or induction noise from a cable connected to an electronic apparatus.

BACKGROUND ART

Generally, in order to prevent radiation noise or induction noise from a signal cable connected between electronic apparatuses and a power supply cable, noise absorbing devices each comprising a split-type cylindrical magnetic core and a core holder receiving the magnetic core therein are attached to such cables. The split-type cylindrical magnetic core comprises a pair of core pieces formed by dividing a cylindrical magnetic core into halves along a cylindrical center axis, the core being for receiving a cable to extend therethrough. The core holder has a structure such that the pair of core pieces are received therein and the pair of core pieces received therein are brought into tight contact with each other. The core holder is made of an insulating material having elasticity, such as nylon.

FIG. 1 is an exploded perspective view of one example of a conventional noise absorbing device of the type described. Referring to FIG. 1, a core holder 10 comprises a pair of holder segments 11 and 12 with receiving recesses. The holder segments 11 and 12 receive a pair of core pieces 20 (only one being illustrated in FIG. 1) with their inner concave surfaces 21 of a semicircular section turned upward, respectively. The pair of core pieces 20 are formed by dividing a cylindrical magnetic core into halves along a cylindrical center axis. Each of the holder segments 11 and 12 has a configuration and a size such that the core piece 20 is received therein with its lip portions 23 outwardly exposed. Each holder segment has four opening edges two of which extend in parallel to the center axis of the magnetic core. At the respective opening edges 24, each of which is one of the above-mentioned two parallel opening edges, the holder segments 11 and 12 are integrally coupled to each other by hinge portions 19 to be foldable. Semicircular notches 13 in conformity with the shape of the inner concave surface 21 of the core piece 20 are formed in the opening edges perpendicular to the center axis of the magnetic core.

Two engaging projections 14 project from a side wall of the holder segment 12. On the other hand, two engaging tabs 15 project from a side wall of the holder segment 11 in correspondence to the engaging projections 14. Protruding pieces 16 are formed on inner walls of the holder segments 11 and 12 at positions slightly below the semicircular notches 13. The protruding pieces 16 have inclined surfaces. End faces of the core pieces 20 slide along the inclined surfaces of the protruding pieces 16 to be easily received in the holder segments 11 and 12. Two cantilever springs 17 (only one being illustrated in FIG. 1) having projections at their top ends are formed in a bottom of each of the holder segments 11 and 12.

With the core pieces 20 received in the pair of holder segments 11 and 12, respectively, the core holder 10 of the above-mentioned structure is attached to a power supply cable (not shown) in the following manner. The signal cable or the power supply cable is extended on the inner concave surfaces 21 of the core pieces 20 and the semicircular notches 13, and opening faces of the holder segments 11 and 12 are butted against each other, then, the engaging tabs 15 being engaged with the engaging projections 14.

FIG. 2 is a vertical sectional view of the core holder 10 after assembled. The signal cable or the power supply cable is not illustrated. Referring to FIG. 2, the core pieces 20 are fixed to the holder segments 11 and 12 by bringing the protruding pieces 16 into contact with the end faces of the core pieces 20. In addition, the lip portions 23 of the pair of core pieces 20 are kept in tight contact with each other by cooperation of the four cantilever springs 17.

In order to reliably fix the core pieces 20 by the protruding pieces 16 in the holder 10, it is necessary to realize the axial length of the core pieces 20 and the distance between the protruding pieces 16 opposite to each other with the high accuracy. However, it is difficult in mass-production to insure the high accuracy of these dimensions.

In view of the above, an approach has been tried to reliably fix the core pieces 20 without requiring such a high dimensional accuracy as mentioned above. For example, as depicted by a dash-and-dot line in FIG. 1, the holder segments 11 and 12 are provided with vertical grooves 18 formed at both sides of each of the protruding pieces 16. Those portions including the protruding pieces 16 are rendered movable so that a freedom is given to the distance between the protruding pieces 16 opposite to each other. There is another approach with respect to the core piece 20 where engaging recesses 22 are formed at opposite ends of the inner concave surface 21 of each core piece 20 for insertion of the top ends of the protruding pieces 16 as depicted by a dash-and-dot line in FIG. 1.

The size of the protruding pieces 16 must be selected small so that a clamping force required to clamp the core pieces 20 is smaller than a pressing force of the cantilever springs 17 and that the core pieces 20 are easily loaded into the holder segments 11 and 12. As a consequence, when the core pieces 20 are inserted into the holder segments 11 and 12, the protruding pieces 16 can not bear the pressing force during insertion and is damaged. Because of a complicated structure including the protruding pieces 16 and the cantilever springs 17, injection molding of the holder 10 often suffers from molding failure such as short mold.

It is therefore a technical object of this invention to provide a noise absorbing device having a holder of a strong structure free from damage during assembly or use.

It is another technical object of this invention to provide a noise absorbing device having a holder of a simple structure.

DISCLOSURE OF THE INVENTION

According to this invention, there is provided a noise absorbing device comprising a pair of core pieces formed by dividing a cylindrical magnetic core into halves along a cylindrical center axis, the core being for receiving therethrough an extension of a cable connected to an electronic apparatus, and a pair of holder segments receiving the pair of core pieces in receiving recesses thereof, respectively, and coupled to enable butt contact with each other so that the pair of core pieces form a cylindrical body with the cable extending therethrough, wherein elastic pieces are interposed between the pair of core pieces and the pair of holder segments receiving the core pieces, respectively, the elastic pieces being for applying an elastic force to the core pieces so that the core pieces are slightly protruded from opening edges of the holder segments, the pair of core pieces being brought into press contact with each other by the elastic force of the elastic pieces when the pair of holder segments are brought into butt contact, assemblies of the core pieces and the elastic pieces being press fitted in the receiving recesses so as to avoid release from the holder segments.

According to this invention, there is also provided a noise absorbing device comprising a pair of core pieces formed by dividing a cylindrical magnetic core into halves along a cylindrical center axis, the core being for receiving therethrough an extension of a cable connected to an electronic apparatus, and a pair of holder segments receiving the pair of core pieces in receiving recesses thereof, respectively, and coupled to enable butt contact with each other so that the pair of core pieces form a cylindrical body with the cable extending therethrough, wherein elastic pieces are interposed between the pair of core pieces and the pair of holder segments receiving the core pieces, respectively, the elastic pieces being adapted for applying an elastic force to the core pieces so that the core pieces are slightly protruded from opening edges of the holder segments, the pair of core pieces being brought into press contact with each other by the elastic force of the elastic pieces when the pair of holder segments are brought into butt contact, assemblies of the core pieces and the elastic pieces being engaged with engaging holes formed at opposite ends perpendicular to the center axis so as to avoid release from the holder segments.

MODE FOR EMBODYING THE INVENTION

Figure 1:
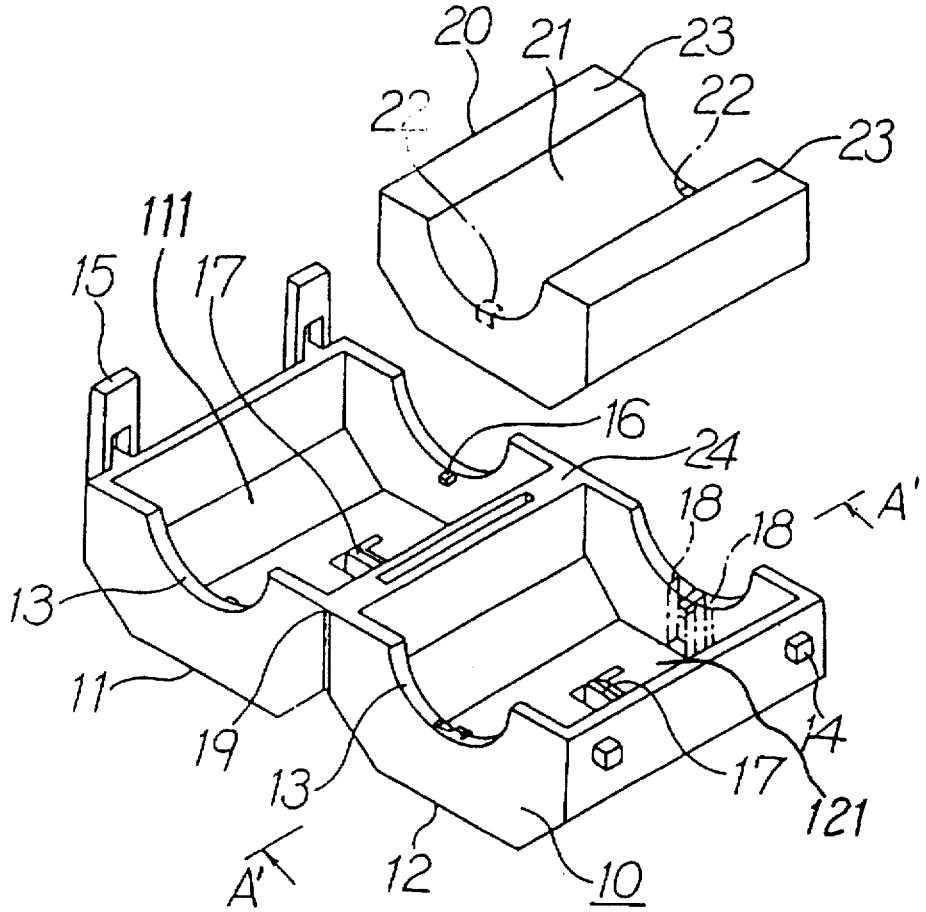
FIG. 1 is an exploded perspective view of one example of a conventional noise absorbing device.

Now, description will be made as regards embodiments of this invention with reference to the drawing. In FIGS. 3 through 12 hereafter referred to in connection with this invention, the same or similar parts corresponding to the conventional example are designated by like reference numerals as shown in in FIGS. 1 and 2.

Figure 2:
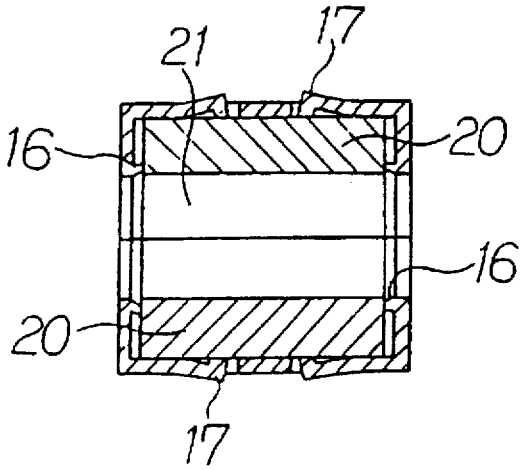
FIG. 2 is a sectional side view of the conventional noise absorbing device in a used state, taken along a line A'—A' in FIG. 1.
Figure 3:
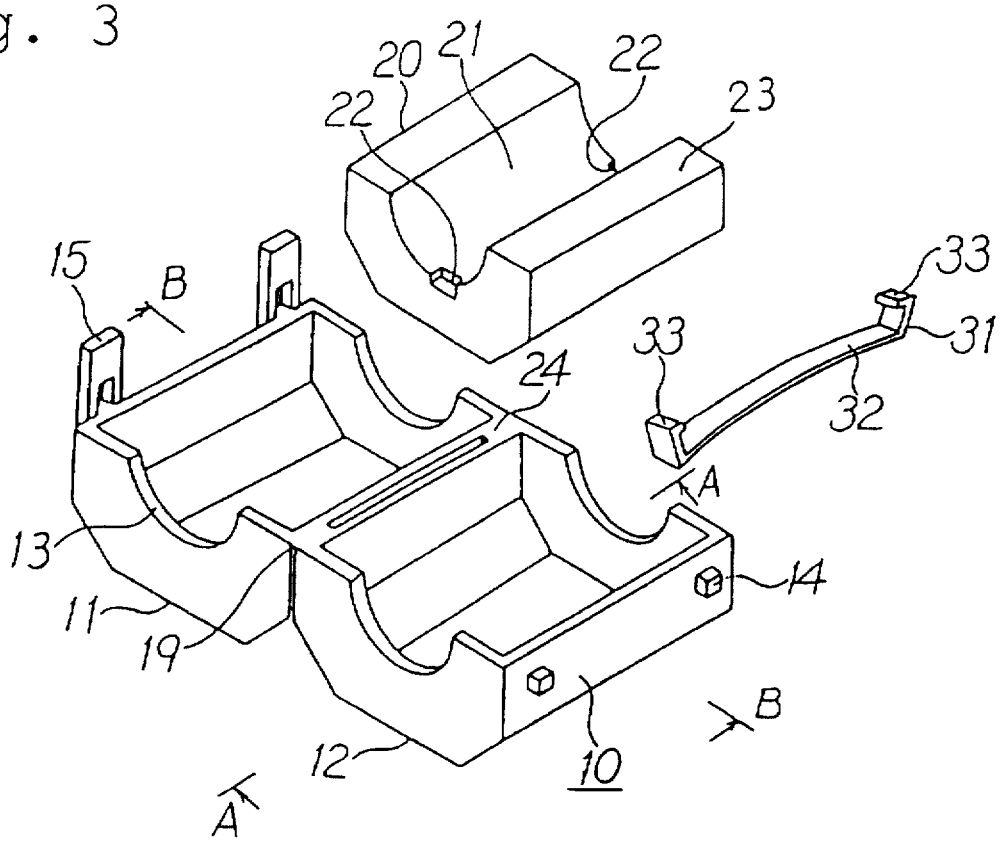
FIG. 3 is an exploded perspective view of a noise absorbing device according to one embodiment of this invention.

Referring to FIG. 3, a core holder 10 according to this embodiment comprises a pair of holder segments 11 and 12 made of insulating resin and having receiving recesses 111 and 121, like the conventional device illustrated in FIG. 1. The holder segments 11 and 12 receive a pair of core pieces 20 (only one being illustrated in FIG. 3) with their inner concave surfaces 21 of the semicircular section turned upward, respectively. The pair of core pieces 20 are formed by dividing a cylindrical magnetic core into halves along a cylindrical center axis. Each of the holder segments 11 and 12 has a configuration and a size such that the core piece 20 is received with its lip portions 23 outwardly exposed. Holder segments 11 and 12 have opening edges and are integrally coupled by hinge portions 19 at their opening edges 24 extending in parallel to the center axis of the magnetic core, adapted to be placed into butt contact with each other. Semicircular notches 13 in conformity with the shape of the inner concave surface 21 of the core piece 20 are formed in the opening edges perpendicular to the center axis of the magnetic core. Two engaging projections 14 project from a side wall of the holder segment 12. On the other hand, two engaging tabs 15 corresponding to the engaging projections 14 project from a side wall of the holder segment 11. The above-mentioned structure is similar to that of the conventional example (FIGS. 1 and 2).

An elastic piece or resilient element 31 made of plastic, rubber, elastic metal, a foaming material, or the like is attached to each core piece 20. The elastic piece or element 31 comprises an arcuately shaped strip body 32 and engaging portions formed at opposite ends thereof. Each engaging portion comprises an upwardly extending portion and an engaging portion 33 angularly extending inwardly therefrom. The strip body 32 has a length equal to or slightly greater than the axial length of the core piece 20 and is arcuately curved upwards to provide elasticity. Thus, it serves as an elastically deformable spring plate.

The elastic piece 31 is attached so that the engaging portions at the opposite ends thereof are engaged with opposite end portions of the core piece 20. In this state, the engaging 33 are lockingly engaged with engaging recesses 22 formed at the inner peripheries of the opposite end portions of the core piece 20. Thus, the core piece 20 is clamped, at inner and outer peripheral surfaces thereof, by the engaging portions at the opposite ends of elastic piece 31.

An assembly of the core piece 20 and the elastic piece 31 attached thereto is press fitted into each of the receiving recesses 111 and 121 (that is, the recesses shown in FIG. 1) of the holder segments 11 and 12.

Thus, the elastic piece 31 exerts an elastic force such that the core piece 20 is pushed up by the strip body 32 outwardly from each of the holder segments 11 and 12. In other words, the core piece 20 is subjected to the elastic force to slightly protrude from the opening edges of each of the holder segments 11 and 12. When one of the holder segments 11 and 12 receiving the core pieces 20 is rotated around the hinge portions 19 to bring the holder segments 11 and 12 into butt contact with each other, the lip portions 23 of the pair of core pieces 20 are pressed in abutting contact with each other.

As is obvious from FIG. 3, the engaging portions at the opposite ends of the elastic piece 31 are outwardly expanded as they extend upwardly from the strip body 32. This structure serves to give a spring property to the engaging portions also.

Figure 5:
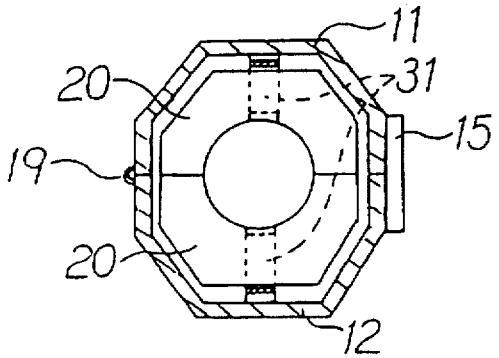
FIG. 5 is a transverse sectional view of the noise absorbing device illustrated in FIG. 3 which device is shown in an assembled condition, taken along a line B—B in FIG. 3.

As illustrated in FIG. 5, the core piece 20 is manufactured to be smaller than each of the receiving recesses 111 and 121 of the holder segments 11 and 12. It is assumed here that, during an assembling process, the elastic piece 31 in the assembly of the core piece 20 and the elastic piece 31 attached thereto is not press fitted into each of the receiving recesses 111 and 121 of the holder segments 11 and 12. In this instance, the assembly is dropped when the holder segment is turned upside down. On the contrary, the engaging portions at the opposite ends of the elastic piece 31 in the assembly are outwardly expanded within each of the receiving recesses 111 and 121 to be brought into press contact with the internal walls of each of the receiving recesses 111 and 121. As a consequence, when the holder segments 11 and 12 are turned upside down during the assembling process, the assemblies are prevented from dropping out from the receiving recesses 111 and 121. The assembly of the core piece 20 and the elastic piece 31 attached thereto is fixed, by press fit, to each of the receiving recesses 111 and 121 of the holder segments 11 and 12. If such press fit is slightly tightened, the engaging portions at the opposite ends of the elastic piece 31 may be formed perpendicular to the strip body 32.

Figure 4:
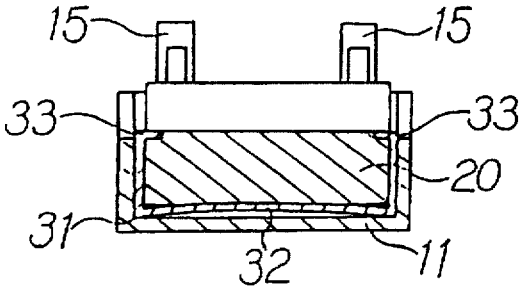
FIG. 4 is a sectional side view of a provisional assembly of the noise absorbing device illustrated in FIG. 3 which is fixedly press fitted into a holder segment, taken along a line A—A in FIG. 3.

FIG. 4 is a vertical sectional view of the assembly of the core piece 20 and the elastic piece 31 attached thereto which is fixedly press fitted into the holder segment 11 (the holder segment 12 being omitted). FIG. 5 is a transverse sectional view of the noise absorbing device according to this invention in an assembled state. Referring to FIG. 4, the core piece 20 is held by the elastically deformable piece 31 within each of the holder segments 11 and 12 and slightly projects from the opening edges of each of the holder segments 11 and 12. As illustrated in FIG. 5, the holder segments 11 and 12 are closed by rotation around the hinge portions 19. When the engaging projections 14 are engaged with the engaging tabs 15, the core pieces 20 forced by elastic elements 31 to slightly project are pushed down against the elastic force of the elastic pieces 31. The pair of core pieces 20 are brought into pressing contact with each other by the elastic force exerted by strip body 32 of elastic element 31.

Figure 6:
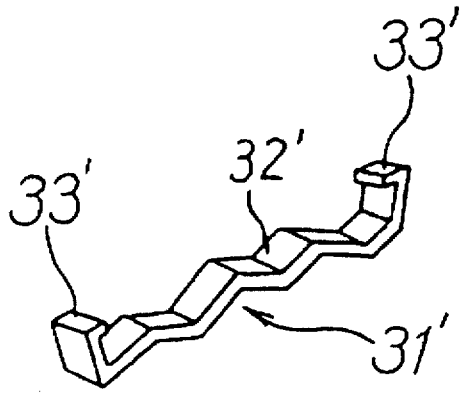
FIG. 6 shows another example of an elastic piece used in the noise absorbing device illustrated in FIG. 3.

FIG. 6 shows an elastic piece according to another embodiment. Referring to FIG. 6, an elastic piece 31' is shown having a strip body 32' of a corrugated shape. This shape provides a spring property greater than that of the arcuate shape in FIG. 3.

Figure 7:
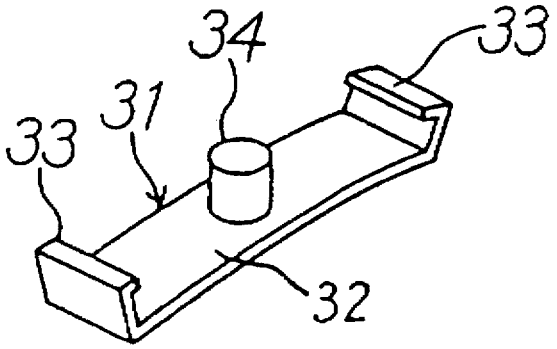
FIG. 7 shows a modification of the elastic piece used in the noise absorbing device illustrated in FIG. 3.

FIG. 7 shows a modification of the elastic piece 31 illustrated in FIG. 3. Referring to FIG. 7, the modification of the elastic piece 31 has a protrusion 34 formed at an intermediate portion of the strip body 32. In this case, it will be understood that a hole adapted for insertion of the protrusion 34 is formed at the outer periphery of the core piece 20.

Figure 8:
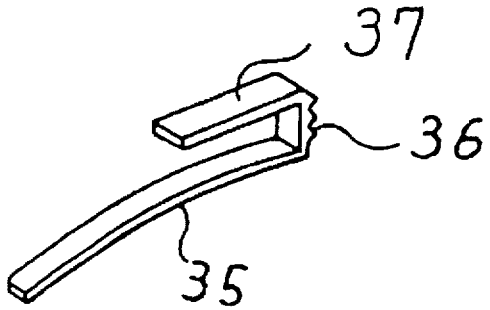
FIG. 8 shows still another example of the elastic piece used in the noise absorbing device illustrated in FIG. 3.

FIG. 8 shows an elastic piece according to still another embodiment. Referring to FIG. 8, the elastic piece has, at one end of the strip body 35 alone, an engaging portion to be engaged with the core piece 20. In this embodiment, a corrugated projection 36 is formed on the outer surface of the engaging portion. An engaging piece 37 has a length longer than that of the engaging piece 33 illustrated in FIG. 3.

Figure 9:
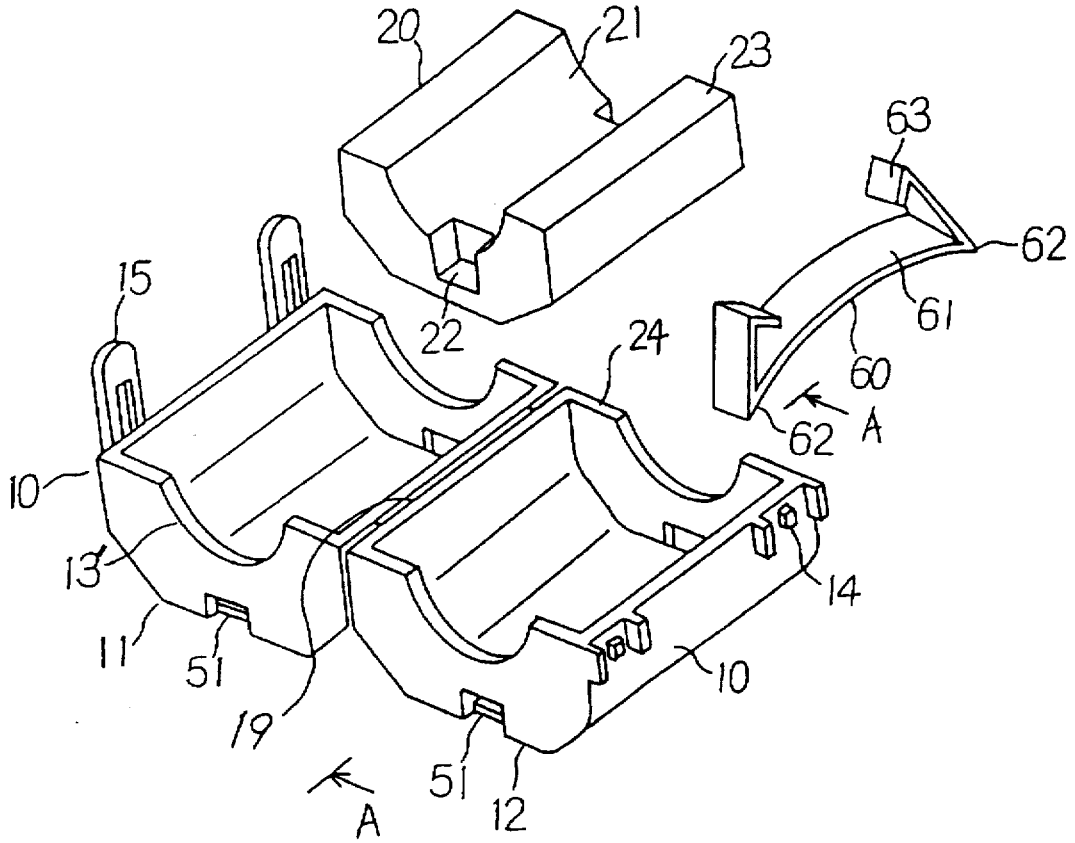
FIG. 9 is an exploded perspective view of a noise absorbing device according to another embodiment of this invention.
Figure 10:
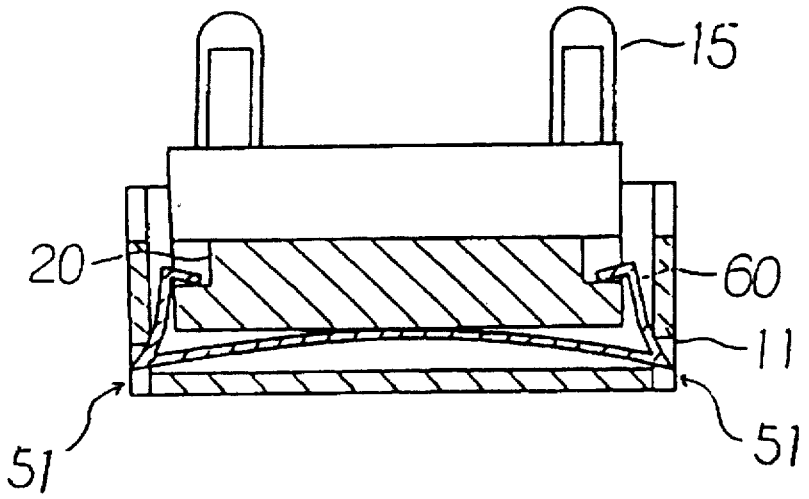
FIG. 10 is a partial sectional side view of a provisional assembly of the noise absorbing device illustrated in FIG. 9 which is fixedly press fitted into a holder segment, taken along a line A—A in FIG. 9.
Figure 11:
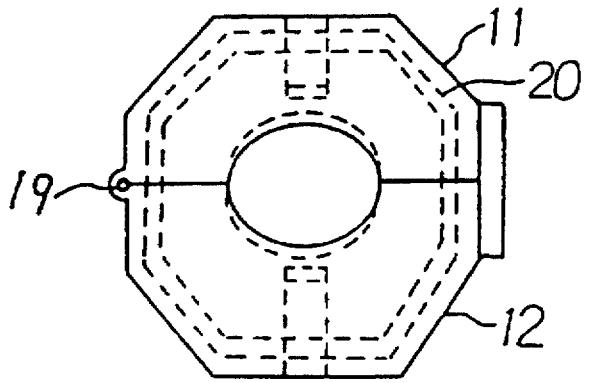
FIG. 11 is a side view of the noise absorbing device illustrated in FIG. 9 in an assembled state, as viewed in an axial direction.

FIGS. 9, 10, and 11 are an exploded perspective view, a partial vertical sectional view, and an axial side view of a noise absorbing device according to another embodiment of this invention, respectively. In these figures, same or similar parts as those of the foregoing embodiment are designated by like reference numerals in FIGS. 3 through 5 and description thereof will be omitted.

Referring to FIGS. 9 through 11, in the noise absorbing device, notches 13' of a semi-elliptical shape slightly smaller than the inner concave surface 21 of the core piece 20 are formed at longitudinal opposite ends of each of the holder segments 11 and 12. By provision of such notches in the holder segments 11 and 12, a cable having a nonuniform diameter can be reliably clamped by the holder segments 11 and 12.

At the longitudinal opposite ends of the holder segments 11 and 12, engaging holes 51 are formed to be engaged with end portions 62 of elastic pieces 60 which will be described below.

Each elastic piece 60 made of a material similar to that of the elastic piece 31 mentioned above comprises a strip body 61, opposite end portions 62, and engaging portions upwardly extending from end portions 62 and comprising engaging elements 63 extending inwardly from the upwardly extending portions.

The end portions 62 of the elastic pieces 60 are engaged with the engaging holes 51 of the holder segments 11 and 12. This prevents drop-off of the assembly of the core piece 20 and the elastic piece 60 from each of the holder segments 11 and 12 and dislocation of contact surfaces of the pair of core pieces 20. In order to remove the assembly from each of the holder segments 11 and 12, disassembling is easily carried out by inserting a penpoint or the like into each engaging hole 51 of the pair of holder segments 11 and 12 in an opened state.

Each engaging hole 51 may have any shape engageable with the end portion 62 of the elastic piece 60, for example, a depression or indent instead of a through hole.

Figure 12:
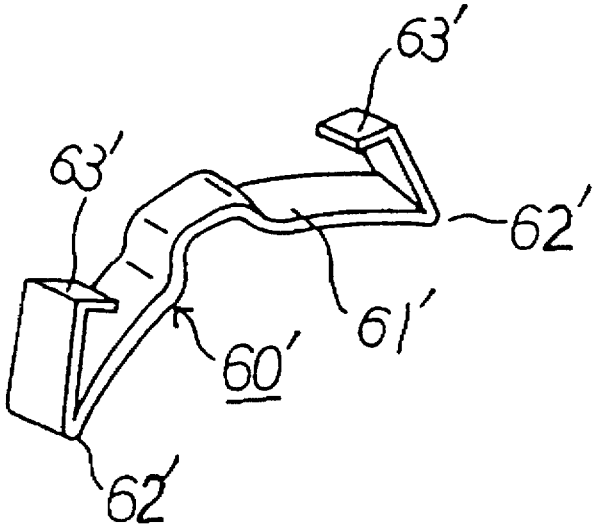
FIG. 12 shows another example of an elastic piece used in the noise absorbing device illustrated in FIG. 9.

FIG. 12 is another example of an elastic piece used in the noise absorbing device illustrated in FIGS. 9 through 11. Referring to FIG. 12, an elastic piece 60' has a strip body 61' of a convex shape. Accordingly, a spring property is greater than that of the elastic piece 60 of an arcuate shape illustrated in FIG. 9.

EFFECT OF THE INVENTION

A noise absorbing device according to this invention has a structure in which the elastic piece or element is interposed between the core piece of the magnetic core and the holder segment. Because the holder segment itself has no complicated structure such as the protruding piece and the cantilever spring, it is possible to avoid a manufacturing failure and a damage of the holder during assembly and use.

Furthermore, the holder segment may be provided with the engaging holes formed at the opposite ends perpendicular to the center axis of the magnetic core. The opposite end portions of the elastic piece clamping the core by clamping portions are engaged with the engaging holes. With this structure, the following effect is obtained.

Since the engagement by the above-mentioned engaging structure is strong, the core piece is free from possibility of dropping out of the holder segment. The condition of the contact surfaces of the pair of core pieces is kept constant so that dislocation of the core pieces is avoided. It is therefore possible to prevent deterioration of the characteristic of the core that is important as the noise absorbing device. Although the engagement of engaged parts is strong, it is possible to easily remove the core piece by pressing the elastic piece through the engaging hole by the use of a pen or the like. Thus, handling is easy.

The notches having a semi-elliptical shape smaller than the inner concave surface or the inner cylindrical surface of the core piece may be formed at the opening edges of the holder segment that are perpendicular to the center axis of the magnetic core. With this structure, it is possible for the holder segment to reliably hold a cable having various diameters.

INDUSTRIAL APPLICABILITY

The noise absorbing device according to this invention is adapted to prevent radiation noise or induction noise from a cable connected to an electronic apparatus.

We claim:

1. A noise absorbing device comprising a pair of core elements formed by dividing a cylindrical magnetic core into halves by a dividing plane including a cylindrical center axis, said core being adapted to receive therethrough an extension of a cable connected to an electronic apparatus including a pair of holder segments having openings and adapted to receive said pair of core elements in core receiving recesses thereof, said pair of holder segments being coupled by a hinge to enable abutting contact with each other and capable of being closed together with their openings in face to face relationship so that said pair of core pieces form a cylindrical core shape with said cable extending therethrough;

wherein each of said core elements have a configuration and a size including an axial core length smaller than each of said core receiving recesses, each of said core elements being provided with a pair of lip portions including lip surfaces determined by said dividing plane and with an inner surface connecting between said lip surfaces in which inner surface a pair of engaging recesses are formed at peripheries of the opposite end portions of each of the core pieces;

wherein elastic pieces are press fitted in said core receiving recesses of said pair of holder segments to hold and prevent said core pieces from falling out of said core receiving recesses and retained therein by frictional engagement with an interior wall of the holder segment and without penetrating said interior wall or any other holder segment interior wall, each of said elastic pieces being made of a deformable elastic material comprising a strip body which has at least one curved portion protruding in an opening direction towards each of said openings and which has a length not less than said axial core length, and a pair of columnar portions extending in said opening direction from both ends of said strip body, and engaging pieces extending from upper ends of said pair of columnar portions towards each other and engaging with said engaging recesses of said core piece, whereby each of said core pieces is held in each of said holder segments with each of said lip portions protruding from each of said holder segments through each of said openings, and whereby when said pair of holder segments are closed together, each of said core pieces is displaced from a protruding position towards the inside of said receiving recess and is forced by reaction of said elastically deformable strip body, which is deformed by the displacement, so that said pair of lip portions of one of said core pieces is brought into abutting contact with said other pair of lip portions of said core pieces to form said cylindrical core shape.

2. A noise absorbing device as claimed in claim 1, wherein each of said pair of holder segments has notches of a semi-elliptical shape adapted to clamp said cable in the opening edges substantially perpendicular to said center axis among said opening edges.

3. A noise absorbing device comprising a pair of core pieces formed by dividing a cylindrical magnetic core into halves by a dividing plane including a cylindrical center axis, said core being adapted to receive therethrough an extension of a cable connected to an electronic apparatus, and a pair of holder segments having openings and receiving said pair of core pieces in core receiving recesses thereof, said pair of holder segments being coupled to each other to enable abutting contact with each other and adapted to be closed together with their openings faced to each other so that said pair of core pieces form a cylindrical core shape with said cable extending therethrough;

wherein each of said core pieces have a configuration and a size including an axial core length smaller than each of said core receiving recesses, each of said core pieces being provided with a pair of lip portions including lip surfaces determined by said dividing plane and with an inner surface connecting between said lip surfaces in which inner surface a pair of engaging recesses are formed at peripheries of opposite end portions of each of the core pieces;

wherein each of said holder segments have opposite end walls disposed along said cylindrical central axis and a pair of engaging holes formed in said opposite end walls adjacent its bottom;

wherein elastic pieces are fixed in said core receiving recesses of said pair of holder segments and to hold and to prevent said core pieces from falling out of said core receiving recesses, respectively, wherein each of said elastic pieces is made of a deformable elastic material comprising a strip body which has at least one curved portion protruding in an opening direction towards each of said openings and which has a length not less than said axial core length, said strip body having a pair of opposite ends engaged with and extending into said engaging holes of each of said holder segments so as to prevent said elastic pieces from falling away from each of said holder segments, and a pair of columnar portions angularly bent at and extending in said opening direction from opposite ends of said strip body, and wherein engaging pieces are provided extending from upper ends of said pair of columnar portions towards each other and engaging with said engaging recesses of said core piece, such that said curved portion of said strip body is pressed by said core piece to be expanded and thereby press said pair of columnar portions onto edge portions of said engaging holes of said holder segments, so that the mutual distances between said pair of columnar portions and between said pair of engaging pieces are reduced to effectively clamp said core pieces in an axial direction thereof, whereby each of said core pieces is held in each of said holder segments with each of said lip portions protruding from each of said holder segments through each of said openings, whereby when said pair of holder segments are closed together, each of said core pieces is displaced from the protruding position towards the inside of said core receiving recess and is forced by reaction of said strip body as it is deformed by said displacement, and whereby said pair of lip portions of one of said core pieces is brought into abutting contact with the pair of lip portions of the other of said core pieces to complete the formation of said cylindrical core shape.

4. A noise absorbing device as claimed in claim 3, wherein each of said pair of holder segments has notches of a semi-elliptical shape adapted to clamp said cable in the opening edges substantially perpendicular to said center axis among said opening edges.

* * * * *